United States Patent [19]

Vogeleer

[11] Patent Number: 4,513,506

[45] Date of Patent: Apr. 30, 1985

[54] MEASURING OF TUBE EXPANSION

[75] Inventor: John P. Vogeleer, Greensburg, Pa.

[73] Assignee: Westinghouse Electric Corp., Pittsburgh, Pa.

[21] Appl. No.: 522,290

[22] Filed: Aug. 11, 1983

[51] Int. Cl.[3] ..... G01B 13/10; G01B 5/12

[52] U.S. Cl. ..... 33/147 K; 33/178 R; 33/178 F; 72/393

[58] Field of Search ..... 33/178 F, 143 R, 147 K, 33/143 L, 174 Q, DIG. 2, 178 R; 72/393

[56] References Cited

U.S. PATENT DOCUMENTS

| | | | |
|---|---|---|---|
| 1,557,846 | 10/1925 | Kallensee | 33/178 R |
| 2,135,912 | 11/1938 | Rae | 33/178 R |
| 2,369,319 | 2/1945 | Smith | 33/178 R |
| 2,542,305 | 2/1951 | Brinen et al. | 72/393 |
| 2,881,529 | 4/1959 | Roch | 33/178 R |
| 2,910,781 | 11/1959 | Bishop | 33/178 R |
| 3,209,460 | 10/1965 | Eisele | 33/174 Q |
| 3,369,302 | 2/1968 | Johnson | 33/178 R |
| 4,067,114 | 1/1970 | Meyer | 33/178 R |

*Primary Examiner*—Willis Little
*Attorney, Agent, or Firm*—L. A. DePaul

[57] ABSTRACT

The expansion of the primary tubes or sleeves of the steam generator of a nuclear reactor plant are measured while the tubes or sleeves are being expanded. A primary tube or sleeve is expanded by high pressure of water which flows through a channel in an expander body. The water is supplied through an elongated conductor and is introduced through a connector on the shank connected to the conductor at its outer end. A wire extends through the mandrel and through the conductor to the end of the connector. At its inner end the wire is connected to a tapered pin which is subject to counteracting forces produced by the pressure of the water. The force on the side where the wire is connected to the conductor is smaller than on the opposite side. The tapered pin is moved in the direction of the higher force and extrudes the wire outwardly of the conductor. The tapered surface of the tapered pin engages transverse captive plungers which are maintained in engagement with the expanding tube or sleeve as they are moved outwardly by the tapered pin. The wire and the connector extend out of the generator and, at its outer end, the wire is connected to an indicator which measures the extent to which the wire is moved by the tapered pin, thus measuring the expansion of the tube or sleeve as it progresses.

15 Claims, 9 Drawing Figures

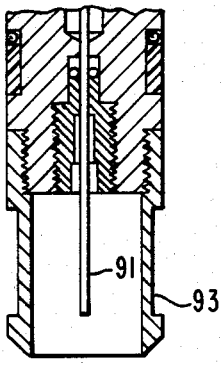
FIG. 7
FIG. 4
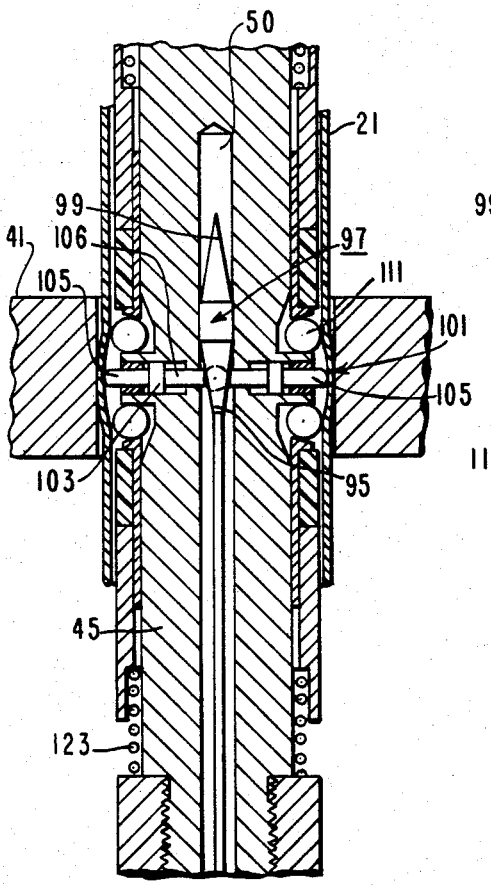
FIG. 5
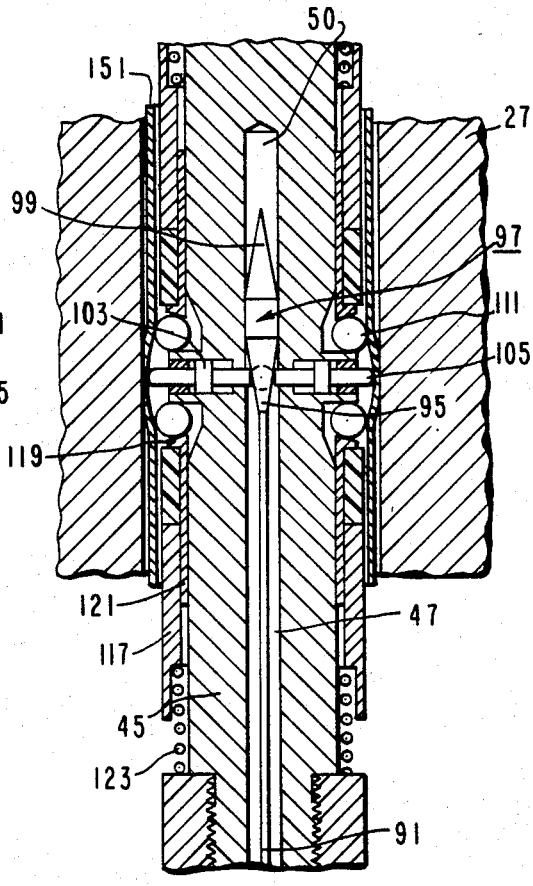

MEASURING OF TUBE EXPANSION

BACKGROUND OF THE INVENTION

This invention relates to the expansion of tubes or sleeves within tubes. It has particular relationship to, and is uniquely suitable for the measurement of the expansion of the tubes or sleeves in tubes of the steam generator of a nuclear-reactor plant which conduct the coolant, i.e., of the primary tubes or their sleeves. The tubes extend into the region of the generator where the feedwater is injected and the heat energy derived from them converts the feedwater into steam. Transverse baffles through which the tubes extend position the tubes. It has been found that the feedwater and steam which flows around the tubes causes them to vibrate. To suppress or reduce substantially the vibration it is desirable to expand the tubes where they pass through the baffles. Typically the expansion should be such that the outer diameter of a tube is 0.001 to 0.003 smaller than the diameter of the hole in the baffle through which it passes.

Another occasion for tube expansion arises in the case of a sleeve which is inserted in a primary tube that has become corroded. In this case, it is necessary to expand the inner end of the sleeve so that it is in engagement with the corroded tube around its periphery. An effective brazed joint may then be produced between the inner end of the sleeve and the sleeved tube. Instead of being brazed the sleeve may be rolled into the tube. The rolling secures the sleeve firmly in the tube and essentially seals the sleeve to the tube.

Typically the expansion takes place during the sleeving. The sleeve inserting tool has an expansion mandrel which penetrates through the sleeve blank. When the sleeve blank is fully inserted in a tube, pressure is applied through the expansion mandrel to expand the sleeve near to inner rim. The pressure applied expands both the sleeve and the part of the tube backing up the sleeve. The sleeve is thus locked in position and does not roll out when the sleeve insertion member is removed.

It may also be desirable to expand the portion of the tube within the tube sheet which separates the secondary region of the generator from the inlet and outlet plenums of the generator although such measurement is not customarily necessary.

It is necessary to preclude expansion of the primary tubes or sleeves so that they are ruptured or are reduced in thickness. Because of the reduced thickness the sleeves or tubes may be ruptured by the coolant flowing through them or the fluid around them. In particular expansion of the sleeves near their upper rims must be limited because the sleeve is backed up only by the tube in this region and may be blown out of the expansion is unlimited. To accomplish the object of limiting the expansion, it is essential that the expansion of the tubes or sleeves be measured while they are being expanded. The expansion, monitored in this way, can be stopped when the thickness of a tube or sleeve has been reduced to a safe but useful magnitude. The interior of the steam generator is highly radioactive and it is necessary that the expansion be measured out of the radioactive environment of the generator. It is an object of this invention to measure the expansion of the primary tubes of a steam generator or of sleeves within the tubes without exposure to radioactivity, while the tubes or sleeves are being expanded. More generally, it is an object of this invention to measure the expansion of a tube while it is being expanded.

SUMMARY OF THE INVENTION

Measurement of the expansion progressively as the tube or sleeve is expanded is achieved, in the practice of this invention, by coordinating the measurement with the expansion. The expansion is produced by pressure of a fluid which is transmitted to the part of the tube or sleeve which is being expanded. A measureable physical manifestation responsive to the fluid pressure is produced. Such a manifestation may be the extrusion of an elongated member; e.g., a wire, by the force resulting from the pressure. The magnitude of the manifestation is coordinated with the expansion of the tube by a mechanism which engages the expanding tube or sleeve and measureably controls this magnitude as the tube or sleeve expands. The instantaneous magnitude of the manifestation is displayed on an indicator.

Specifically, an expansion mandrel or expander body is inserted into the tube or sleeve. The pressure for the expansion is provided by a pressure fluid which flows through a long fluid conductor, into a channel in the mandrel and thence in contact with the tube or sleeve to be expanded. Typically, the fluid is water and the pressure is between 13000 and 20000 pounds per square inch. In accordance with this invention, an elongated member, typically a wire, extends through the channel and through the elongated conductor to a position outside of the outer end of a connector connected to the conductor. A tapered pin is connected to the inner end of the conductor. The tapered pin extends into a plenum which contains the fluid under pressure. The axial force produced by the pressure on the part of the tapered pin remote from the elongated member is higher than the axial force produced by the pressure on the same side of the tapered pin as the elongated member. This difference results from the fact that no axial force is impressed on the area of the tapered pin where it joins the elongated member. The tapered pin is moved by this excess of force in the direction of the higher force; i.e., away from the inner end of the mandrel. The elongated member is also extruded or moved outwardly. A plurality of transverse or radial captive pins or plungers extend through the mandrel between the elongated member and the tube or sleeve. The captive pins are engaged by the tapered surface of the tapered pin and are moved transversely by the tapered pin in constant engagement with the tube or sleeve as the tube or sleeve expands. There is a linear relationship, dependent on the taper of the tapered pin, between the outward movement or extrusion of the elongated member and the expansion measured by the movement of the captive pins. Typically, the angle of the taper may be 22° 38′ so that the ratio of taper is 5 to 1, i.e., at any axial distance from the apex of the taper, the radial distance is 1/5 the axial distance. In this typical case movement of the captive pins 0.001 inch radially produces movement of the elongated member 0.0025 inch axially. A dial, connected to the outer end of the elongated member, continuously measures the magnitude of the movement of the member as the tube or sleeve is expanded. The expansion of the tube or sleeve as it expands is thus known and may be controlled.

It may happen, in the practice of this invention, that a tube or sleeve may be expanded as a whole or over a large area. In the usual practice of this invention, only a part of a tube or sleeve, usually a small part, is expanded, The reference to expansion of a tube or sleeve in this application and in its claims is to be interpeted to mean expansion of all or any part of a tube or sleeve.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which:

FIG. 4 is a fragmental view in longitudinal section showing the expansion of a tube is expanded in a baffle in accordance with this invention;

FIG. 5 is a fragmental view in longitudinal section showing the expansion of a tube into tube sheet;

FIG. 7 is a fragmental view in section showing a protective sleeve for the emerging or extruded end of the longitudinal member.

DESCRIPTION OF THE PREFERRED EMBODIMENTS

Figure 1:
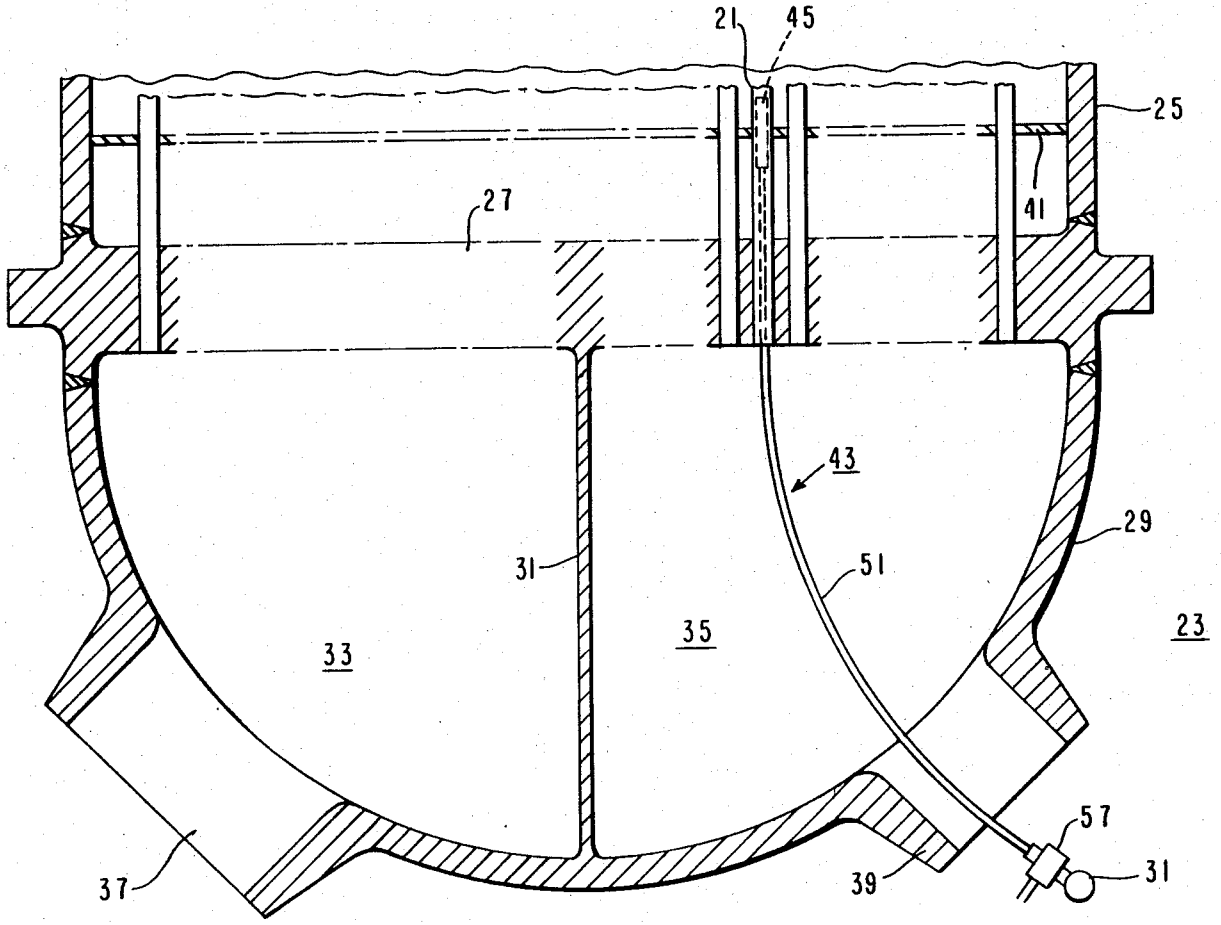
FIG. 1 is a fragmental view in transverse section of a part of a steam generator showing the expanding and measuring apparatus in accordance with this invention in its relationship to a tube to be expanded.

FIG. 1 shows how the apparatus according to this invention is used in expanding a tube 21 of a steam generator 23. The generator 23 has a circularly cylindrical body 25 across whose base a tube sheet 27 extends. Below the tube sheet, the generator 23 is closed by a generally spherical closure 29 which is called a channel head. The closure 29 is divided by a partition 31 into coolant-inlet and coolant-outlet plenums 33 and 35. The inlet-plenum 33 has an inlet port 37 through which coolant flows into the plenum 33. A corresponding outlet port (not shown) is connected to the outlet plenum 35 for conducting the coolant from the plenum 35 to the nuclear-reactor (not shown). There are also one or more manways 39. The tubes 21 are typically of U-shape and span the partition 31. They are seal welded pressure tight to the tube sheet. Coolant flows from the inlet plenum 33 to the outlet plenum 35 through the tubes 21. The tubes 21 are positioned and partly supported by baffles 41. There are also generators whose tubes are linear. In this case, the inlet plenum is at one end of the generator, usually the bottom, and the outlet plenum is at the other end, the top. This invention is applicable to such generators. The coolant flowing through tubes 21 transmits heat to feedwater which flows into body 25 converting the feedwater into steam. It has been found that the fluid in body 25 causes the tubes to vibrate. To suppress the vibration, some of the tubes 21 are expanded so that they are spaced only a short distance from the adjacent boundaries of the baffles 41 through which the tubes pass.

In the practice of this invention, a tube 21 is expanded by a predetermined magnitude so that it is spaced as desired from the boundaries of the holes in the baffles 41. The magnitude of expansion is set by monitoring the expansion as it occurs and discontinuing the operation when the desired magnitude is reached.

Figure 2A:
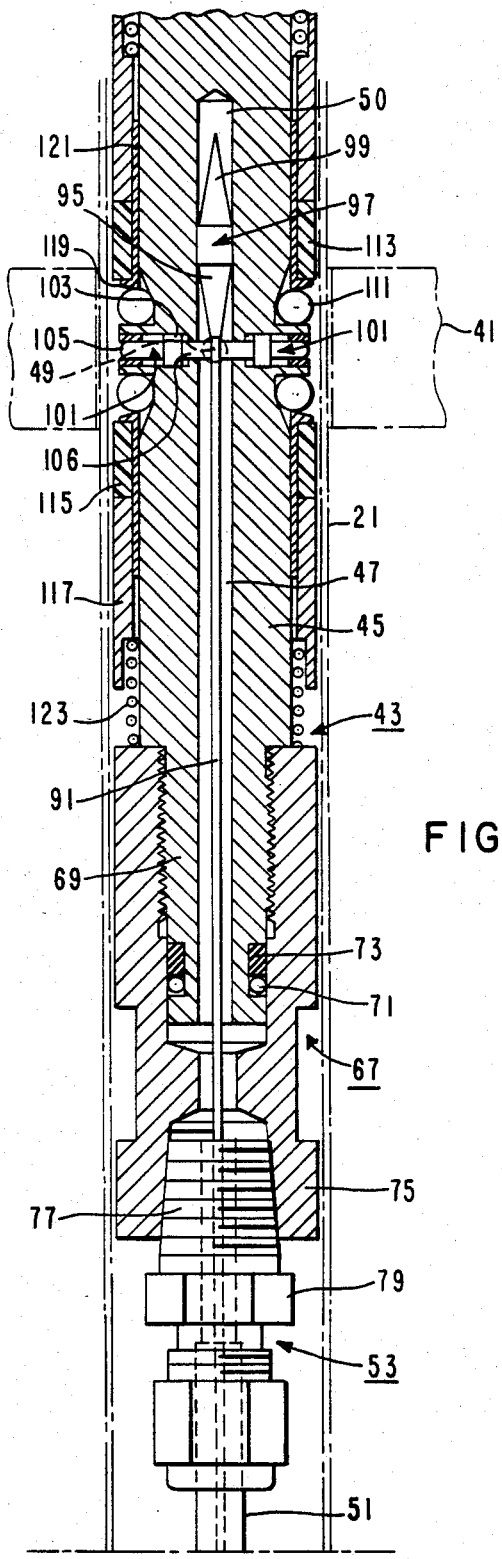
FIGS. 2A, 2B, 2C together constitute a view predominantly in longitudinal section of the expanding and measuring apparatus in accordance with this invention with the fluid-feed conductor shown unsectioned and with the expansion indicating means and its connector shown in side elevation.
Figures 2B, 6:
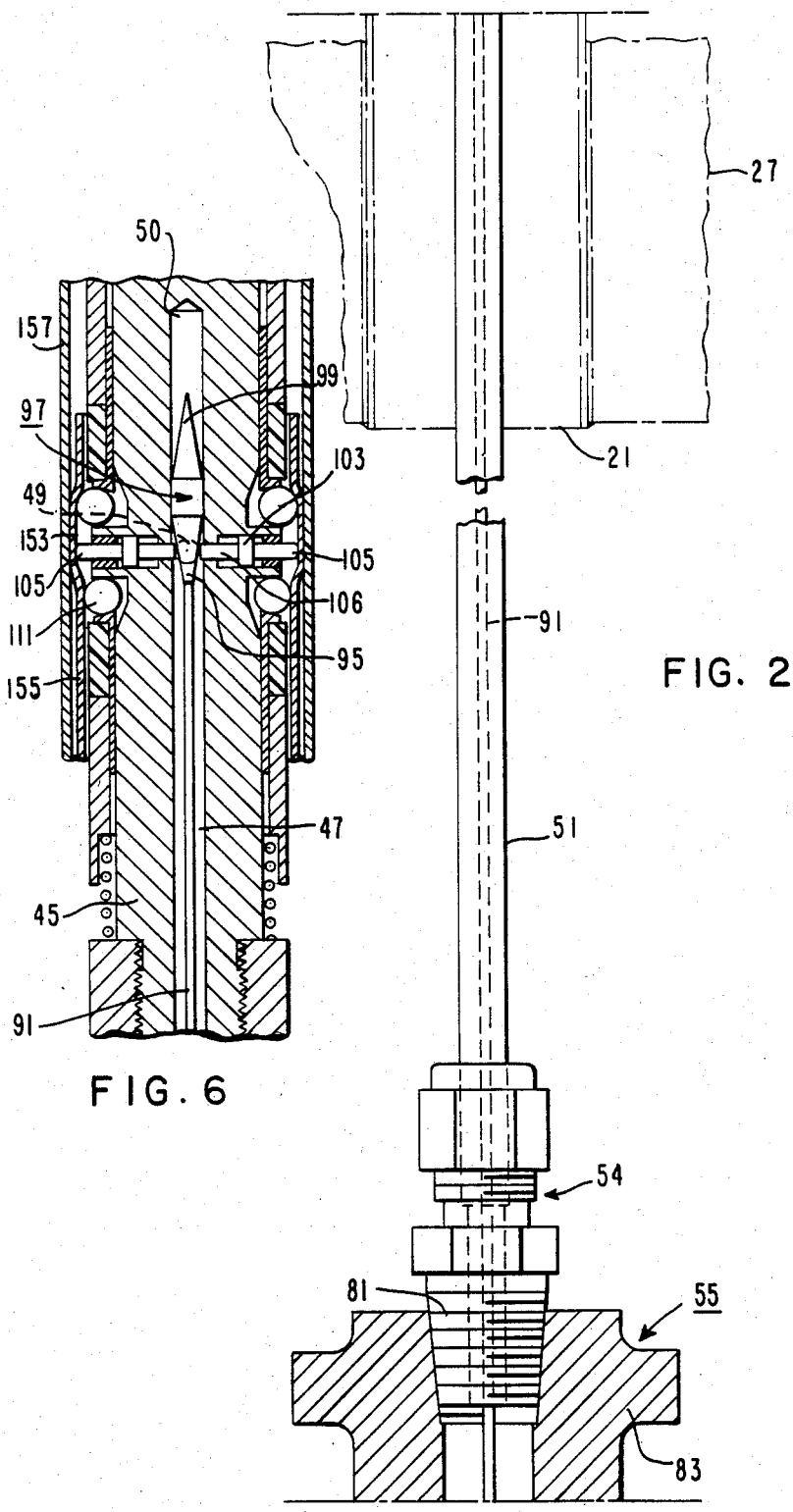
FIG. 6 is a fragmental view in longitudinal section showing the expansion of a sleeve into a tube so that it may be effectively brazed to the tube.
Figure 2C:
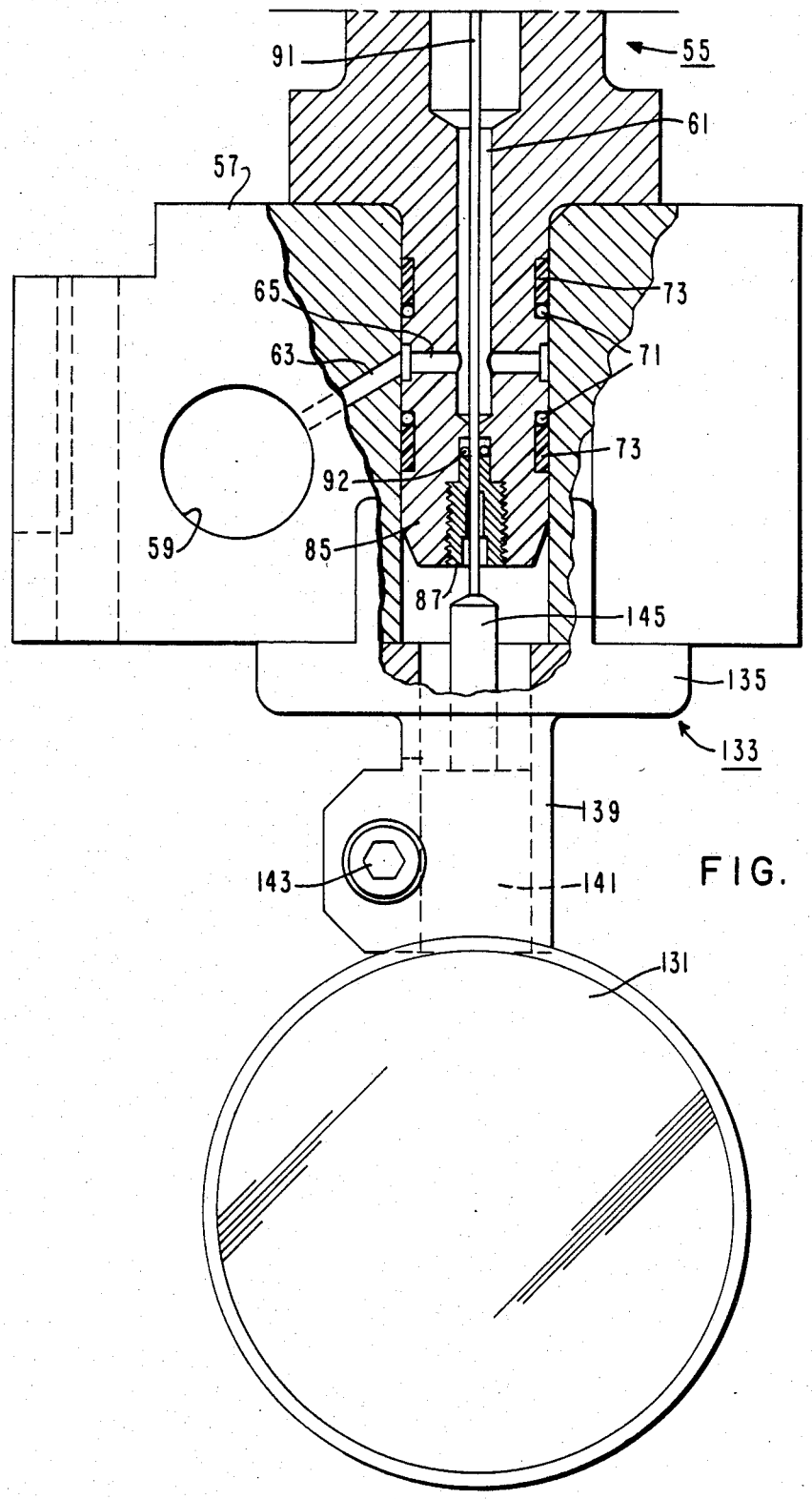

The expansion and monitoring is carried out by expanding and measuring apparatus 43 (FIGS. 2A, 2B, 2C). This apparatus includes a mandrel or expander body 45 which extends into the region of the tube 21 that is to be expanded. The body 45 has a channel 47 for conducting the fluid, typically water at high pressure, for producing the expansion. Holes 49 are provided in body 45 for transmitting the fluid to the inner surface of the tube 21 so that the tube is expanded. The channel 47 terminates in a plenum 50 which extends beyond holes 49 and into which the pressure fluid flows. Typically, the tubes 21 are composed of INCONAL alloy so that very high pressure is required to produce the expansion. The fluid is supplied through a flexible elongated fluid feed conductor 51 which is connected to the expander body 45 through a pressure tight joint 53, typically a SWAGE LOC joint. The conductor 51 extends out of the channel head 29 through the manway 39 (FIG. 1). At its protruding end the fluid feed conductor is connected through a pressure-tight, SWAGE LOC joint 54 to a shank or connector 55 (FIG. 2C). The connector 55 is connected pressure tight to a connector block 57. Block 57 has a receptical 59 for a fitting (not shown) through which the fluid is injected. A fluid channel 61 in shank 55 is connected to the fluid feed conductor 51. The receptacle 59 is connected fluid tight to channel 61 through communicating holes 63 and 65 in the block 57 and the shank 55 (FIG. 2C).

The expander body 45 is connected to the pressure-tight joint through an intermediate connector 67 (FIG. 2A). At its end 69, connected to the body 45, the connector 67 has an internal thread which engages an external thread on body 45. Below its thread the body 45 has a circumferential groove forming an annular slot with the inner surface of the intermediate connector 67. Within this slot there is an O-ring 71 abutted by a cylinder 73 of a material such as urethane. The cylinder 73 and the O-ring 71 are in pressure communication with each other. The O-ring 71 alone would be unable to resist the high pressure which is applied. The cylinder *7b* absorbs the pressure which the O-ring would be unable to resist. At its other end 75, the intermediate connector 67 is provided with an internal pipe thread. This thread is engaged by the thread 77 on the pressure tight (SWAGE LOC) joint 53. The joint 53 is provided with a hex member 79 for tightening the thread 77.

The pressure-tight joint 54 at its end 81, secured to connector 55, also has a pipe thread which engages an internal pipe thread in the adjacent end 53 of connector 55. At its other end the connector 55 has a stem 85 which is a tight fit into an opening in block 57. The stem 85 is positioned in block 57 so that the openings 63 and 65 are in communication. To seal the stem 85 pressure tight sealing units each consisting of an O-ring 71 and an abutting cylinder 73 of a material such as urethane are provided in annular slots on both sides of the passages 65. At its nose, the stem 85 is closed by a back-up screw 87.

To measure the expansion of the tube 21 as it progresses an elongated member 91, typically a wire, extends through the channel 45 and conductor 51, and out through back-up screw 87. The member 91 passes through a sealing O-ring 92 adjacent the inner end of screw 87. Desirably, a protective sleeve 93 may be provided for the protruding end of member 91 (FIG. 7). At its inner end the member 91 is connected to the apex of the tapered end 95 of a pin 97. (FIG. 2A) The member 91 may extend into a hole in the apex and may be soldered to the pin 97 at the junction of the member and hole. The pin 97 is slideable in plenum 50 where it is subject to the pressure of the fluid which produces the expanding pressure. The opposite end 99 of pin 97 is shown tapered but it need not be tapered. It may take any form and particularly may be flat on top.

At the end 99, the inward axial component of the fluid pressure is exerted over the maximum cross-sectional transverse area of the pin 97. At the end 95, the outward axial component of the pressure is exerted over a transverse area equal to the maximum area over which the inward pressure is exerted less the cross-sectional area of the pin 91. The total inward axial force (downward as seen in FIG. 2A) (pressure x area) exceeds the total outward force (upward as seen in FIG. 2A). The pin 97 is moved inwardly by the fluid pressure and the member 91 is extruded through the end of screw 87.

The measure of the expansion of tube 21 is transmitted by radial oppositely extending plungers or captive pins 101. Each plunger consists of a control cylindrical bearing member 103 from whose ends fingers 105 and 106 extend. The bearing member 103 slides in a transverse slot in the expander body 45. The outwardly extending fingers 105 are guided by bushings 107 in the slots. The inner fingers 106 of the plungers 101 engage the tapered surface of the tapered inner end 95 of pin 97. As the fluid pressure urges the pin 97 inwardly, the outer fingers 105 engage the expanding region of tube 21. The magnitude of the extrusion of member 91 is thus set by the magnitude of the expansion of the tube 21.

The regions of the fingers 105 of the tube 21 are sealed by units each consisting of an O-ring 111 backed up by urethane cylinders 113 and 115. On each side of the sealing units, each cylinder 113 and 115 is interposed between the upper edge of an outer sleeve 117 and the flange 119 of an inner sleeve 121. Each cylinder 113 and 115 is urged towards the corresponding O-ring 111 by a spring 123 which engages an inner shoulder in outer sleeve 117.

Figure 3:
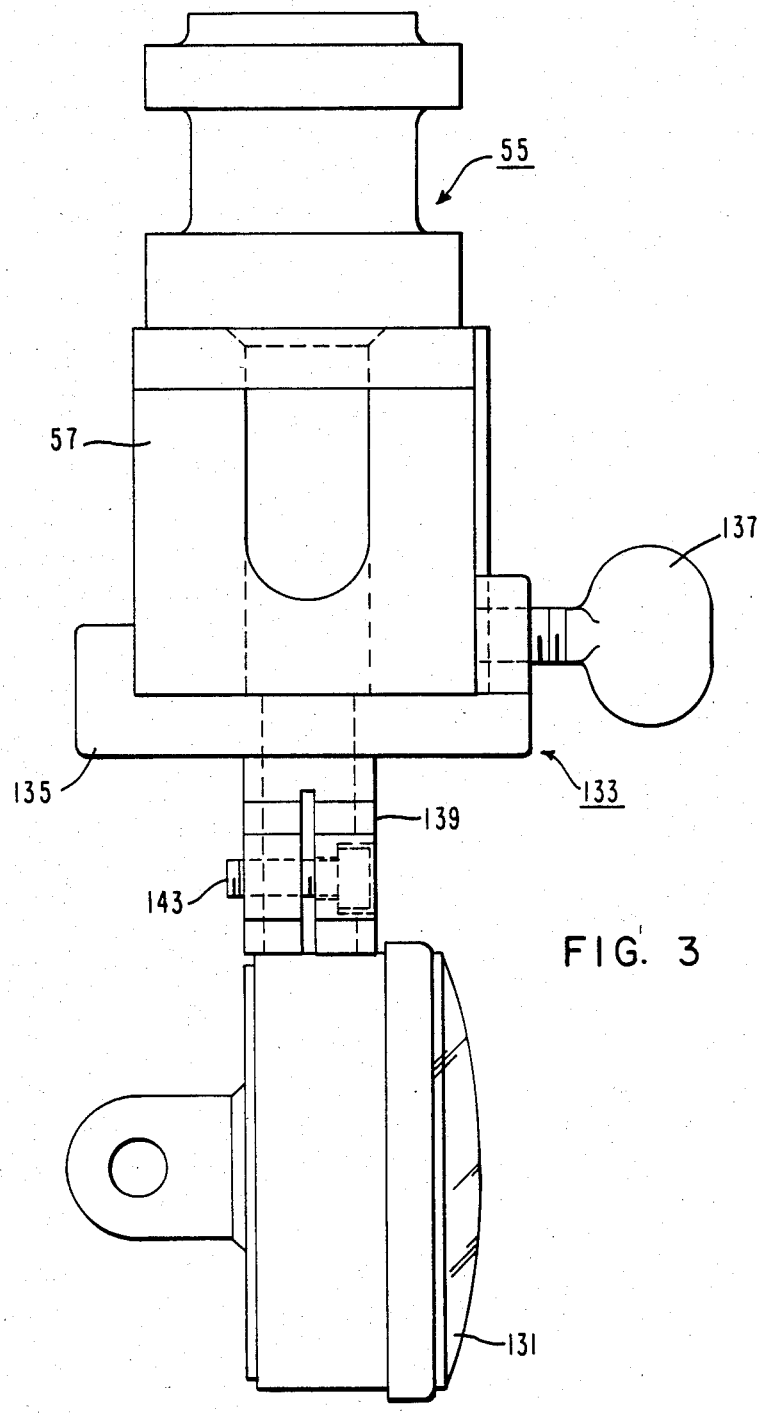
FIG. 3 is a view in end elevation of the indicating means and its connector.

An indicator 131 is suspended from a clamp 133 secured to the connector block 57 (FIGS. 2C, 3). The clamp has channel-shaped end 135 (which is secured to block 57 by a thumb screw 137 (FIG. 3). A split sleeve 139 extends from the end 135. The sleeve 139 is clamped to the stem 141 of the indicator 131 by a bolt 143 which passes through ears extending from the sleeve. The indicator 131 has a sliding member 145 which passes through the stem 141 and the end 135 into the connector block 57 where it is contracted by the elongated member 91. As the sliding member 145 is moved inwardly (downwardly with reference to FIG. 2C) by the extrusion of the elongated member 91, it causes the indicator to measure the extrusion and thus the expansion of tube 21.

In the use of the apparatus 43, the expander body 45 is inserted in tube 21 with the fingers 105 in engagement with the tube 21 in the region where it is to be expanded. Fluid is transmitted through conductor 51 and channel 47. The pressure of the fluid is measured. When the pressure is at about 3000 pounds per square inch, the indicator 131 is set to 0. When the desired expansion is read on the dial of the indicator 131, the pressure supply is vented. Where the taper of the end 95 is, for example, 5 to 1, the dial reading must be divided by 2.5 to obtain the expansion.

In FIG. 4, it is shown that the tube is attenuated in thickness in the region where it is expanded. An important function of this invention is that it enables the operator to terminate the expansion before the expanded region becomes too thin to serve any useful purpose or is penetrated.

FIG. 5 shows the expansion of a tube 151 into the tube sheet 27. The tube 151 is attenuated in the region in which it is expanded.

FIG. 6 shows the expansion of the portion 153 near end of a sleeve 155 in a tube 157. By expansion, the end 153 of the sleeve is engaged with the inner surface of tube 157 around its periphery. Brazing of sleeve 155 to tube 157 is facilitated. If desirable, the tube 157 may be backed up by a baffle 41 or the tube sheet 27. Where the tube is not backed up the expansion must be limited. The portion 153 of the sleeve which is expanded must extend a short distance above the expansion region into the region above the upper O-ring 101. In this region the pressure of the expansion fluid is 0. Blow this region there would be substantial downward pressure on the upper rim of the sleeve 155.

While preferred embodiments of this invention have been disclosed herein, many modifications thereof are feasible. This invention is not to be restricted except insofar as is necessitated by the spirit of the prior art.

What is claimed is:

1. Apparatus for expanding a tube conducting the coolant from a nuclear reactor of the steam generator of a nuclear reactor plant, or a sleeve within a tube, the said apparatus including a tube-expansion mandrel to be disposed within said tube or sleeve and having a channel for conducting fluid under high pressure to expand said tube or sleeve, an elongated fluid-feed conductor, connected to said mandrel to supply said fluid to said channel, an elongated member extending through said mandrel and through said fluid-feed conductor to a position remote from the radioactive atmosphere within said generator, means, connected to said elongated member, responsive to the pressure of said fluid, for moving said member outwardly of said conductor, means to be interposed between said elongated member and said tube or sleeve, moveable by said moving means transversely of said member into engagement with said tube or sleeve as said tube or sleeve is expanded, the movement of said elongated member by said moving means to be limited by the engagement of said transversely moveable means with said tube or sleeve, and indicating means, connected to said elongated member at said position and responsive to the outward movement of said elongated member, for indicating the expansion of said tube or sleeve while said tube or sleeve is being expanded whereby the expansion of said tube or sleeve can be controlled.

2. Apparatus for expanding a tube or a sleeve within a tube including a tube-expansion mandrel to be disposed within said tube or sleeve and having a channel for conducting fluid under high pressure to expand said tube or sleeve, an elongated fluid-feed conductor, connected to said mandrel to supply said fluid to said channel, an elongated member extending through said mandrel and through said fluid-feed conductor means, connected to said elongated member, responsive to the pressure of said fluid, for moving said member outwardly of said conductor, means to be interposed between said elongated member and said tube or sleeve, moveable by said moving means transversely of said member into engagement with said tube or sleeve as said tube or sleeve is expanded, the movement of said elongated member by said moving means to be limited by the engagement of said transversely moveable means with said tube or sleeve, and indicating means, connected to said elongated member and responsive to the outward movement of said elongated member, for indicating the expansion of said tube or sleeve while said tube or sleeve is being expanded whereby the expansion of said tube or sleeve can be controlled.

3. The apparatus of claim 1 wherein the transversely moveable means includes a plurality of captive pins extending transversely through said the mandrel between the elongated member and to extend to the tube, and the moving means includes a tapered pin connected to the elongated member near the position where said elongated member engages said captive pins, said tapered pin being tapered outwardly therefrom, whereby when said moving means moves said elongated member, the tapered surface of the tapered pin moves the captive pins outwardly towards constant engagement with the tube.

4. The apparatus of claim 2 wherein the transversely moveable means includes a plurality of captive pins extending transversely through said the mandrel between the elongated member and to extend to the tube, and the moving means includes a tapered pin connected to the elongated member near the position where said elongated member engages said captive pins, said tapered pin being tapered outwardly therefrom, whereby when said moving means moves said elongated member, the tapered surface of the tapered pin moves the captive pins outwardly towards constant engagement with the tube.

5. The apparatus of claim 1 wherein the moving means is contacted by the pressure fluid in a plenum extending beyond the region where the fluid is to be conducted to the tube, the said plenum being in communication with the channel through which the fluid is conducted and the fluid therein being at the same pressure as the fluid to be conducted to the tube.

6. The apparatus of claim 2 wherein the moving means is contacted by the pressure fluid in a plenum extending beyond the region where the fluid is to be conducted to the tube, the said plenum being in communication with the channel through which the fluid is conducted and the fluid therein being at the same pressure as the fluid to be conducted to the tube.

7. The apparatus of claim 5 wherein the transversely moveable means includes a plurality of captive pins extending through the mandrel and to extend to the tube, and the moving means includes a tapered pin, connected to the elongated member near the position where said elongated member engages said captive pins, said tapered pin being tapered outwardly from said elongated member, said tapered pin extending moveably into the plenum intermediate its ends, so that the fluid pressure exerts a first force on the tapered pin on the side thereof remote from said elongated member and a second smaller force on the tapered pin on the side thereof where it is engaged by the elongated member, whereby said tapered pin and said elongated member are moved in the direction of the first force and the tapered surface of the tapered pin moves the captive pins outwardly towards constant engagement with said tube.

8. The apparatus of claim 6 wherein the transversely moveable means includes a plurality of captive pins extending through the mandrel and to extend to the tube, and the moving means includes a tapered pin, connected to the elongated member near the position where said elongated member engages said captive pins, said tapered pin being tapered outwardly from said elongated member, said tapered pin extending moveably into the plenum intermediate its ends, so that the fluid pressure exerts a first force on the tapered pin on the side thereof remote from said elongated member and a second smaller force on the tapered pin on the side thereof where it is engaged by the elongated member, whereby said tapered pin and said elongated member are moved in the direction of the first force and the tapered surface of the tapered pin moves the captive pins outwardly towards constant engagement with said tube.

9. The apparatus of claim 1 wherein the moving means for moving the elongated members includes a pin connected on one side to the elongated member, said pin being subject to the pressure of the fluid, said fluid exerting a first force on the side of the pin remote from the elongated member and a second smaller force on the side of the pin where it is connected to the elongated member, whereby the pin and the elongated member connected to it are moved in the direction of the first force.

10. The apparatus of claim 2 wherein the moving means for moving the elongated members includes a pin connected on one side to the elongated member, said pin being subject to the pressure of the fluid, said fluid exerting a first force on the side of the pin remote from the elongated member and a second smaller force on the side of the pin where it is connected to the elongated member, whereby the pin and the elongated member connected to it are moved in the direction of the first force.

11. Apparatus for expanding a tube of a steam generator which conducts the coolant from a nuclear reactor of a nuclear reactor plant or for expanding of a sleeve within a plant, the said apparatus including means to be disposed within said tube or sleeve, for conducting fluid under high pressure to expand said tube, means actuable by the high pressure, expanding said tube, producing at a position external of the radioactive atmosphere within said generator, a physical measureable manifestation of the force exerted by said high pressure means, to be connected to said expanding tube within said fluid conducting means, for coordinating continuously the instantaneous magnitude of said manifestation with the expansion of said tube so that said magnitude is a function of the expansion, and means, connected to said manifestation-producing means for continuously indicating, at said position, the magnitude of said expansion so that the expansion can be controlled.

12. Apparatus for expanding a tube or a sleeve within a tube including means to be disposed within said tube or sleeve, for conducting fluid under high pressure to expand said tube, means actuable by the high pressure, expanding said tube, producing a physical measureable manifestation of the force exerted by said high pressure means, to be connected to said expanding tube within said fluid conducting means, for coordinating continuously the instantaneous magnitude of said manifestation with the expansion of said tube so that said magnitude is a function of the expansion, and means, connected to said manifestation-producing means for continuously indicating the magnitude of said expansion so that the expansion can be controlled.

13. The apparatus of claim 11 wherein the manifestation-producing means is an elongated conductor extending throughout the fluid conducting means which is extruded outwardly of said fluid-conducting means responsive to the force produced by the pressure, the instantaneous movement of said elongated conductor being dependent on the instantaneous expansion of the tube or sleeve.

14. The apparatus of claim 12 wherein the manifestation-producing means is an elongated conductor extending throughout the fluid conducting means which is extruded outwardly of said fluid-conducting means responsive to the force produced by the pressure, the instantaneous movement of said elongated conductor being dependent on the instantaneous expansion of the tube or sleeve.

15. Apparatus for expanding a tube or sleeve and measuring the expansion as it progresses including means to be disposed within said tube or sleeve, for conducting fluid under high pressure to expand said tube or sleeve, an elongated member extending through said conducting means, means connected to said member, and responsive to the pressure of said fluid for extruding said member from said fluid-conducting means and means connected to said extruding means and to be connected to the region of said tube or sleeve being expanded for controlling the extrusion of said member in dependence upon the expansion of the tube or sleeve at said region.

* * * * *